US006431245B1

(12) United States Patent
Shen

(10) Patent No.: US 6,431,245 B1
(45) Date of Patent: Aug. 13, 2002

(54) WINDOW SHADE

(75) Inventor: Chang Han Shen, Chang Hua Hsien (TW)

(73) Assignee: Gee Mei Handicraft Company Limited, Chang Hua Hsien (TW)

( * ) Notice: Subject to any disclaimer, the term of this patent is extended or adjusted under 35 U.S.C. 154(b) by 0 days.

(21) Appl. No.: 09/739,609

(22) Filed: Dec. 19, 2000

(51) Int. Cl.[7] ..... E06B 3/48
(52) U.S. Cl. ..... 160/84.03; 160/84.07
(58) Field of Search ..... 160/84.03, 84.07, 160/115, 134

(56) References Cited

U.S. PATENT DOCUMENTS 4,799,524 A * 1/1989 Guermonprez
5,092,383 A * 3/1992 Niemeijer et al.
5,197,526 A * 3/1993 Schon
5,207,257 A * 5/1993 Rupel
5,341,864 A * 8/1994 Rupel et al.
5,860,464 A * 1/1999 Schon

* cited by examiner

*Primary Examiner*—Blair M. Johnson
(74) *Attorney, Agent, or Firm*—Harrison & Egbert

(57) ABSTRACT

A window shade is formed of a top rail, a pliable shade body, and a pull cord set. The top rail has an arresting member and two actuating members. The shade body is provided with a plurality of cross pleats, a middle tube, and a bottom tube. The middle tube is provided with a middle cross rod fitted thereinto. The bottom tube is provided with two bottom cross rods fitted thereinto. The shade body can be folded to have an ornamental form by the pull cord set in conjunction with the arresting member and the two actuating members.

2 Claims, 8 Drawing Sheets

WINDOW SHADE

BACKGROUND OF THE INVENTION

1. Field of the Invention

The present invention relates generally to a window shade, and more particularly to a window shade having a versatile shade body.

2. Description of Related Art

Conventional window shades are generally monotonous in design at best. Such window shades do not give an added decorative effect to the room. U.S. Pat. No. 5,207,257 discloses a window shade having a shade body which can be folded to have an ornamental form. However, this prior art window shade is defective in design because its two pull cords must be pulled at the time when the shade body is folded, thereby resulting in a great deal of inconvenience in folding the window shade.

BRIEF SUMMARY OF THE INVENTION

The primary objective of the present invention is to provide a window shade comprising a top rail, a pull cord set, and a pliable shade body. The top rail is provided with an arresting member and two actuating members. The shade body is provided with a plurality of cross pleats, which are connected with the pull cord set. The shade body is provided at the bottom side with a bottom tube into which two bottom cross rods are fitted. The shade body is further provided in the there of with a middle tube into which a middle cross rod is fitted. The shade body can be folded to have an ornamental shape using the pull cord set in conjunction with the arresting member and the actuating members of the top rail.

DETAILED DESCRIPTION OF THE INVENTION

Figure 1:
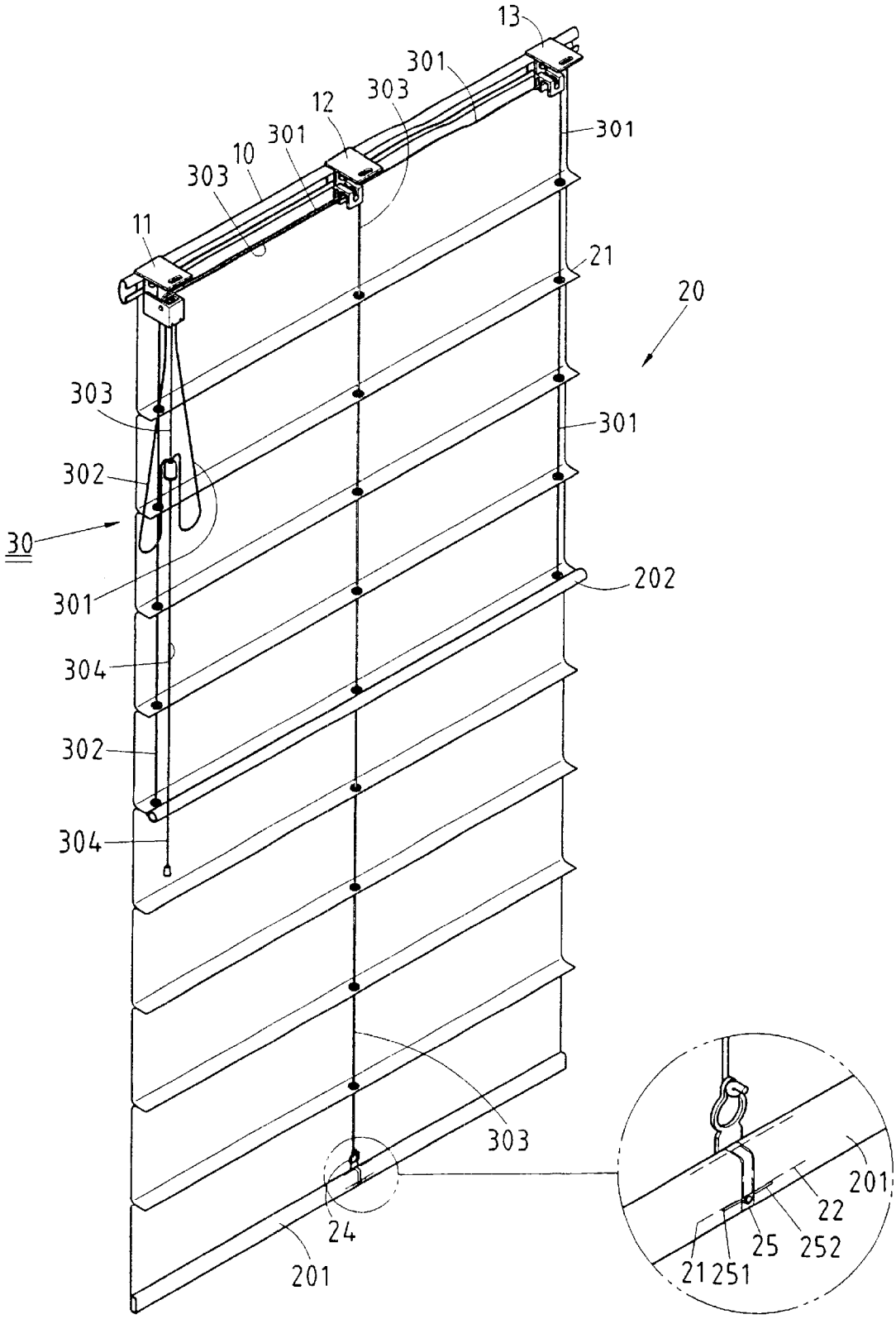
FIG. 1 shows a perspective view of the present invention.
Figure 2:
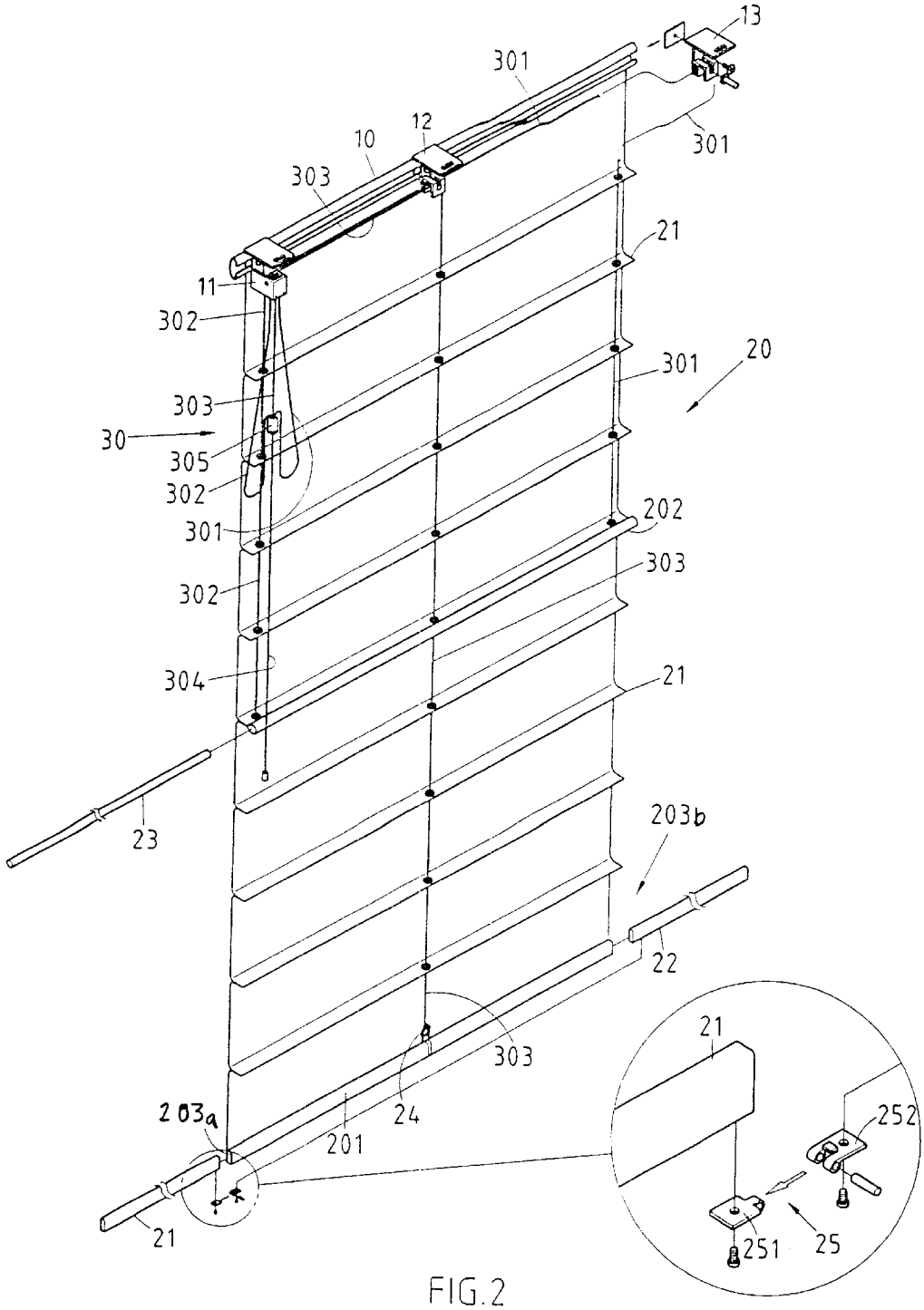
FIG. 2 shows an exploded view of the present invention.
Figure 3:
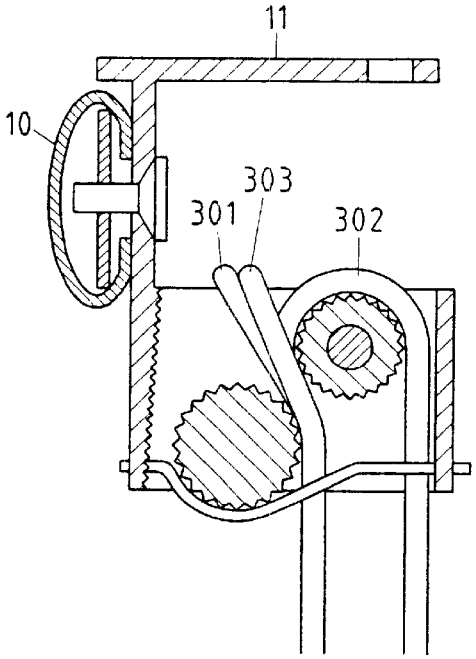
FIG. 3 shows a sectional view of the pull cord set and the arresting member of the present invention.
Figure 4:
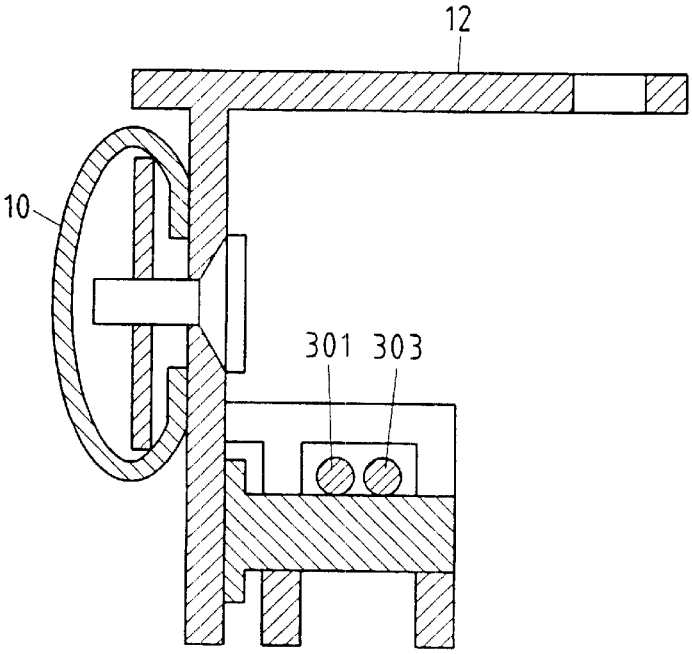
FIG. 4 shows a sectional view of the pull cord set and the actuating members of the present invention.
Figure 5:
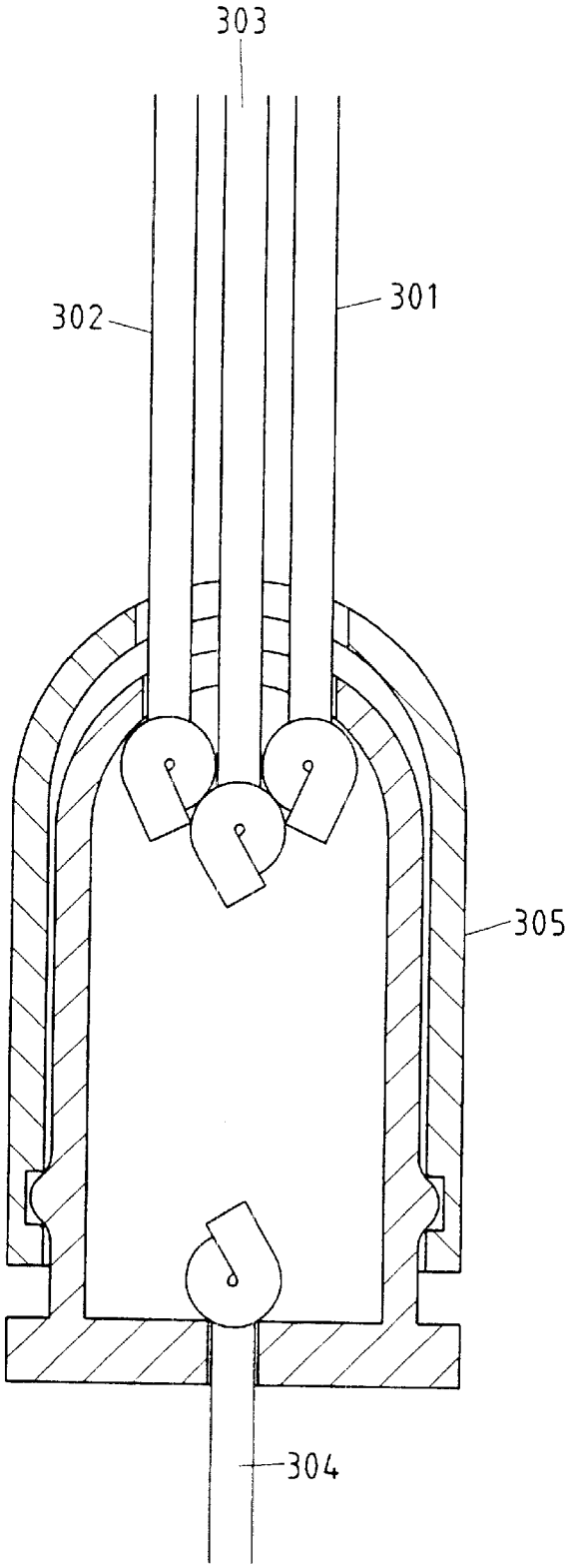
FIG. 5 shows a sectional view of the pull cord set and the locating member of the present invention.

As shown in all drawings provided herewith, a window shade embodied in the present invention comprises a top rail 10, a pliable shade body 20, and a pull cord set 30.

The top rail 10 is provided at one longitudinal end with an arresting member 11, at the midsegment with a first actuating member 12, and at the opposite longitudinal end with a second actuating member 13.

The shade body 20 is fastened at the top slide with the top rail 10 and is provided with a plurality of cross pleats 21 which are arranged at an interval and are parallel to the top rail 10. The shade body 20 is provided at the bottom side with a bottom tube 201, which has two longitudinal ends 202 and 203. The bottom tube 201 is provided with two bottom cross rods 21 and 22, which are fitted into the bottom tube 201 via the longitudinal ends 203*a* and 203*b*. The shade body 20 is further provided in the midsegment with a middle tube 202, which is stitched in place and is provided with a middle cross rod 23 fitted thereinto. The middle tube 202 is parallel to the bottom tube 201 and the top rail 10.

The pull cord set 30 comprises two side pull cords 301 and 302, a middle pull cord 303, an active pull cord 304, and a locating member 305. When the shade body 20 is completed unfolded, the first side pull cord 301 is connected with the locating member 305 which is disposed under the arresting member 11 by an appropriate distance. The first side pull cord 301 is connected at other end with the middle tube 202 via the actuating members 12, 13, and a plurality of the cross pleats 21. The middle pull cord 303 is connected at one end with the locating member 305, and at other end with an annular body 24 of the bottom tube 201 via the arresting member 11 and the actuating member 12. The second side pull cord 302 is connected at one end with the locating member 305, and at other end with the middle tube 202 via the arresting member 11. The active pull cord 304 is fastened at the top end with the locating member 305.

The bottom tube 201 is provided as the center with a hinge 25 fastened thereto. The hinge 25 is provided with two connection pieces 251 and 252, which are connected respectively with the two bottom cross rods 21 and 22 of the bottom tube 201.

Figure 6:
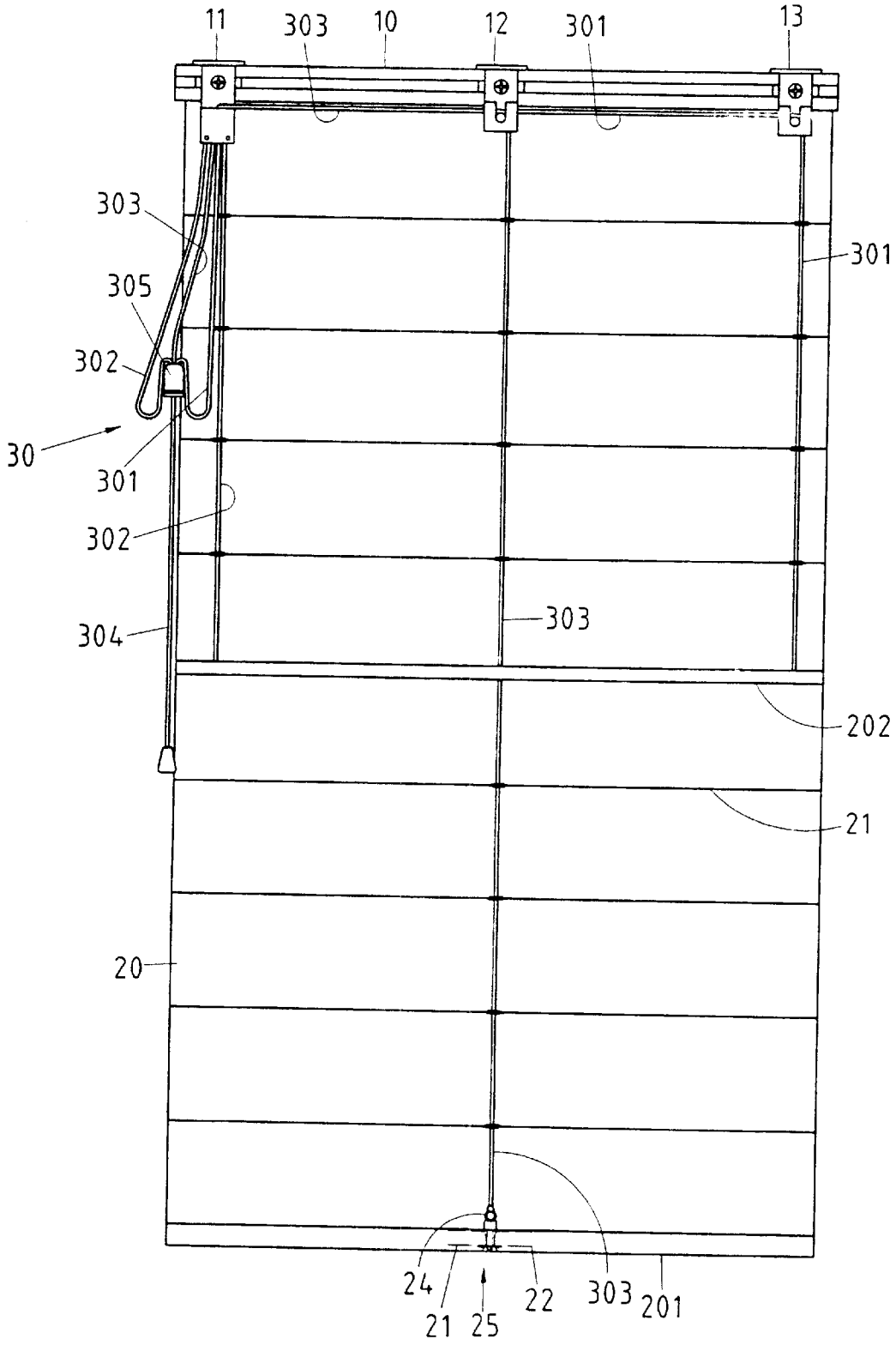
FIG. 6 shows a front view of the present invention in the unfolding state.
Figure 7:
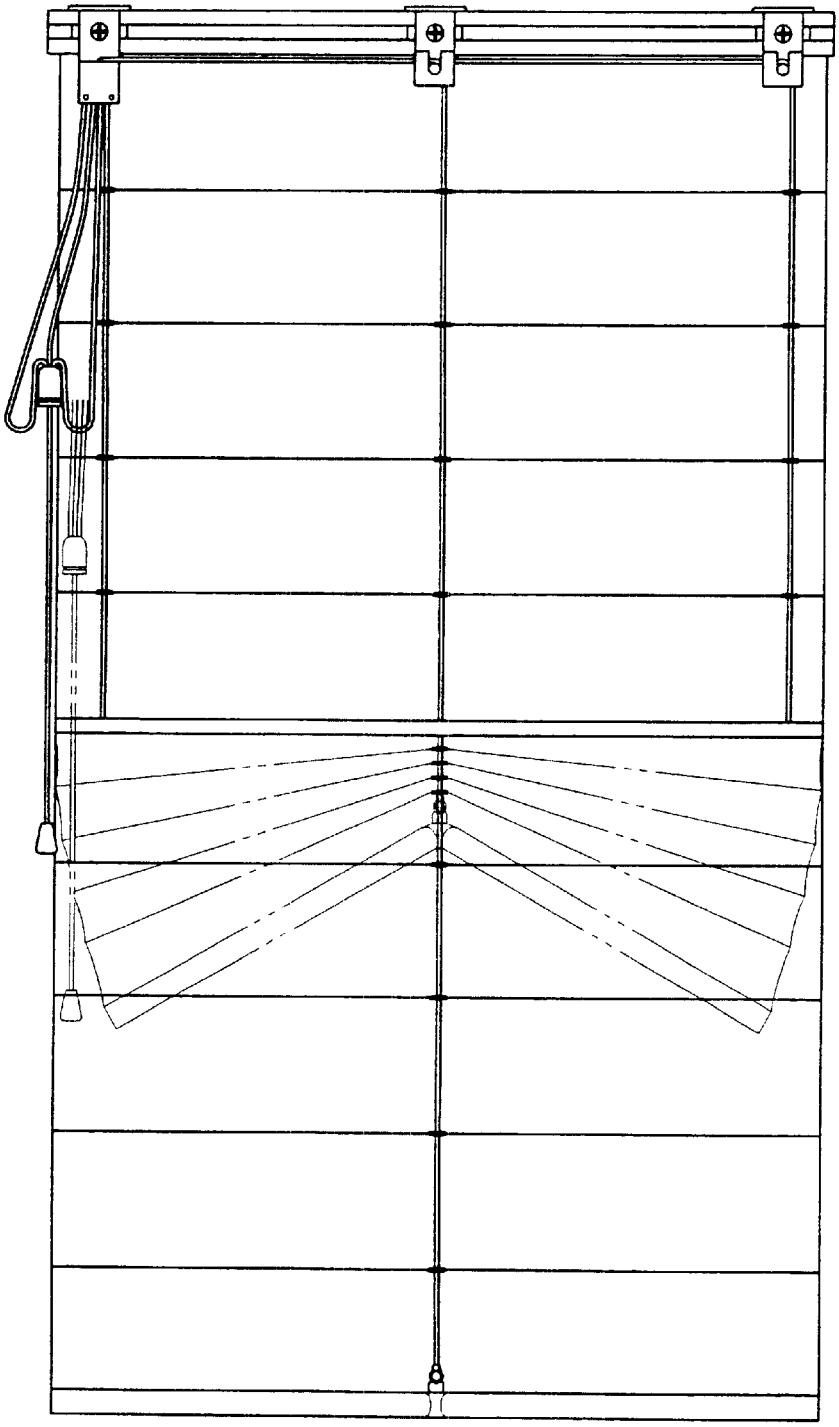
FIG. 7 shows a schematic view of the present invention being folded.
Figure 8:
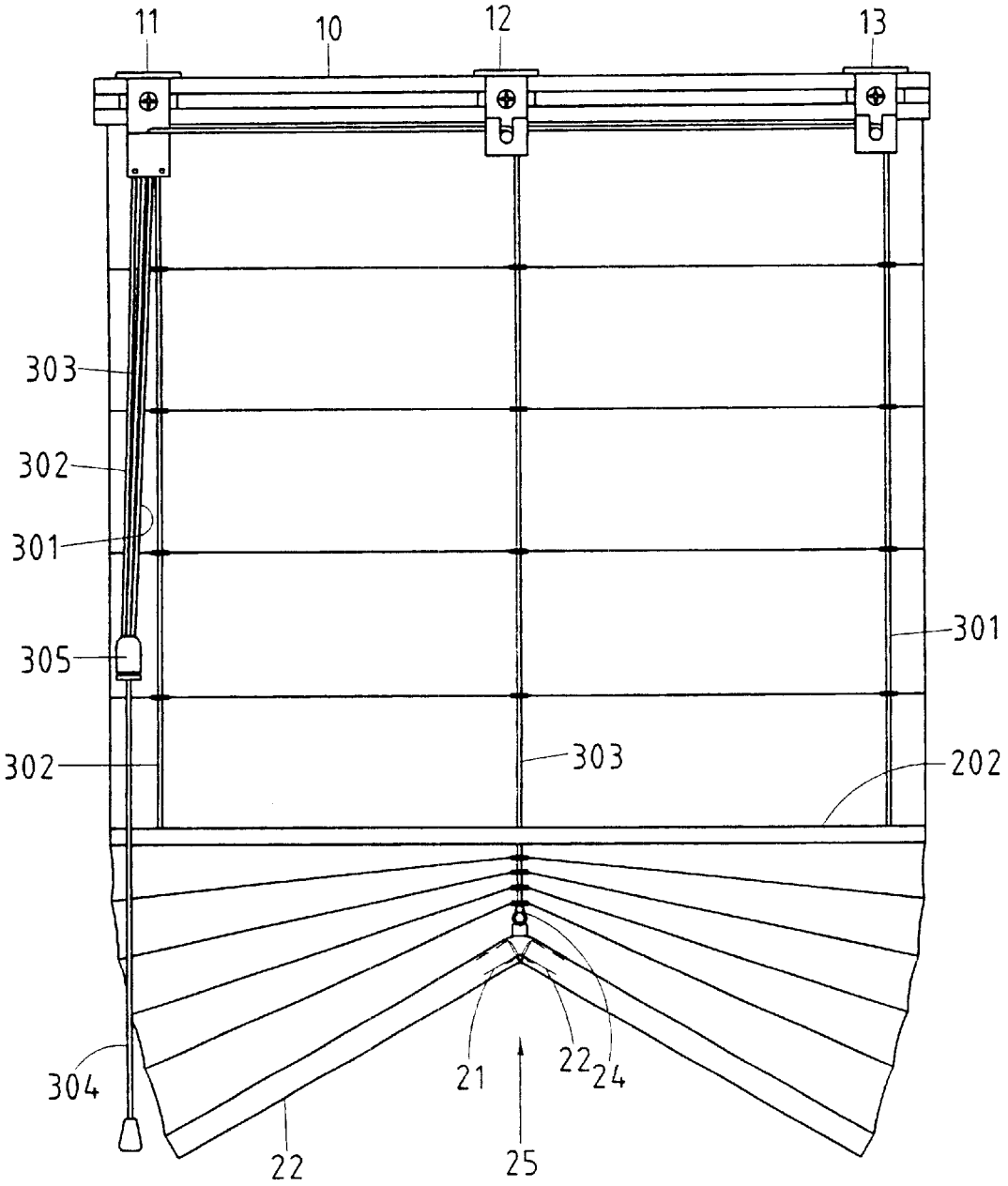
FIG. 8 shows a schematic view of the present invention which is partially folded.
Figure 9:
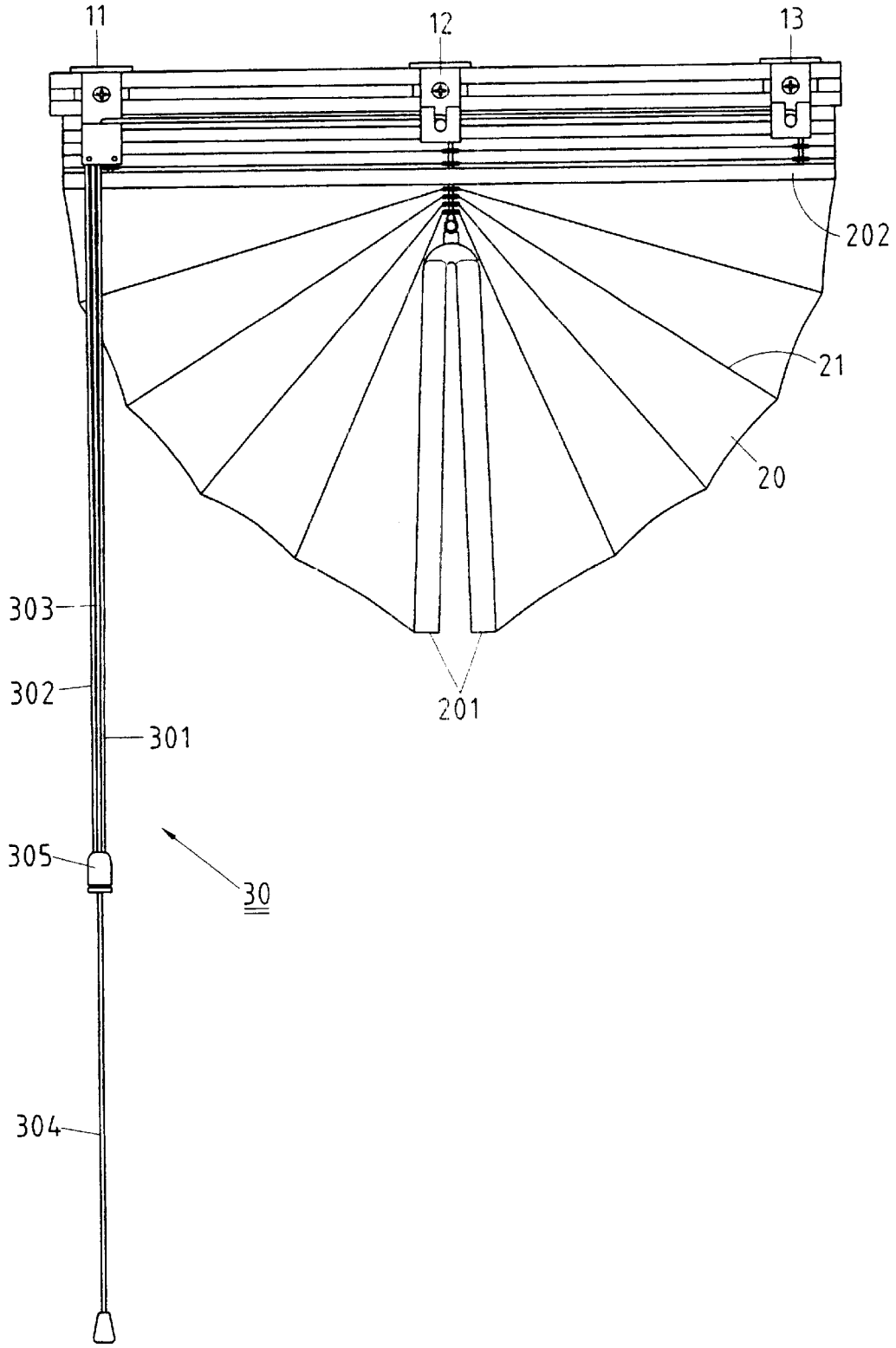
FIG. 9 shows a schematic view of the present invention which is completely folded.

As illustrated in FIGS. 6–9, when the active pull cord 304 is pulled, the pull cords 301, 302 and 303 are linked by the locating member 305, thereby causing the bottom tube 201 to be lifted by the middle pull cord 303. In light of both longitudinal ends of the bottom tube 201 being burdened with the weights of the two bottom cross rods 21 and 22, the shade body 20 is caused to have an inverted sectional shape. As the active pull cord 303 is further pulled downward, the sectional portion of the shade body 20 is drawn to be near the middle tube 202. In the meantime, the middle tube 202 is actuated by the pull cords 301, 302, and 303 to move upward, thereby causing the shade body 20 above the middle tube 202 to fold.

I claim:

1. A window shade comprising:

a top rail having an arresting member at one end thereof, said top rail having a first actuating member at a center thereof, said top rail having a second actuating member at an end opposite said arresting member;

a shade body fastened at a top side to said top rail, said shade body having a plurality of cross pleats extending in spaced parallel relation to said top rail, said shade body having a bottom tube at a bottom side thereof, said bottom tube having two bottom cross rods fitted into opposite ends of said bottom tube, said shade body having a middle tube in a middle section thereof, said middle tube having a middle cross rod fitted thereinto, said bottom tube having an annular body affixed at a center thereof;

a locating member positioned below said arresting member by a distance;

a first side pull cord having one end connected to said locating member, said first side pull cord having another end connected to said middle tube of said shade body via said first actuating member and said second actuating member and said plurality of cross pleats of said shade body;

a middle pull cord having one end connected to said locating member, said middle pull cord having an opposite end connected to said annular body of said bottom tube via said arresting member and said first actuating member; and a second side pull cord having one end connected to said locating member, said second side pull cord having an opposite end connected to said middle tube via said arresting member; and an active pull cord having a top end fastened to said locating member.

2. The member shade of claim 1, said bottom tube of said shade body having a hinge at a center thereof, said hinge connected to said two bottom cross rods by respective two connection pieces.

* * * * *